US006863630B1

(12) United States Patent
Watkins et al.

(10) Patent No.: US 6,863,630 B1
(45) Date of Patent: Mar. 8, 2005

(54) HUNTING ARROWHEAD WITH BLEEDER RING

(76) Inventors: Larry R. Watkins, 6749 N. 14th Dr., Phoenix, AZ (US) 85013; Mark W. Watkins, 2325 N. Kramer, Flagstaff, AZ (US) 86001; Kevin B. Call, 1530 W. Schultz Pass Rd., Flagstaff, AZ (US) 86001

( * ) Notice: Subject to any disclaimer, the term of this patent is extended or adjusted under 35 U.S.C. 154(b) by 0 days.

(21) Appl. No.: 10/631,317

(22) Filed: Jul. 30, 2003

(51) Int. Cl.[7] ..... F42B 6/08
(52) U.S. Cl. ..... 473/583
(58) Field of Search ..... 473/583, 584

(56) References Cited

U.S. PATENT DOCUMENTS 2,888,264 A * 5/1959 Sharrar ..... 473/585
3,741,542 A * 6/1973 Karbo ..... 473/584
3,756,600 A * 9/1973 Maleski ..... 473/584
5,064,202 A * 11/1991 Barner ..... 473/583
RE34,397 E * 10/1993 DelMonte et al. ..... 473/584
5,417,440 A * 5/1995 Barrie et al. ..... 473/584
5,494,298 A * 2/1996 Maleski ..... 473/584
6,077,180 A * 6/2000 Adams, Jr. ..... 473/584

* cited by examiner

*Primary Examiner*—John A. Ricci
(74) *Attorney, Agent, or Firm*—H. Gordon Shields

(57) ABSTRACT

Hunting arrow utilizes an arrowhead having a ferrule and a plurality of blades, and a cutting ring is secured to the blades. The blades are secured to the ferrule by a tip and by a retainer nut adjacent to the shaft. Different configurations of rings may be utilized, and the rings may be secured to the outer or inner portions of the blades. Different configurations of both arrowheads and rings which may be secured to an arrow shaft are illustrated and discussed.

26 Claims, 4 Drawing Sheets

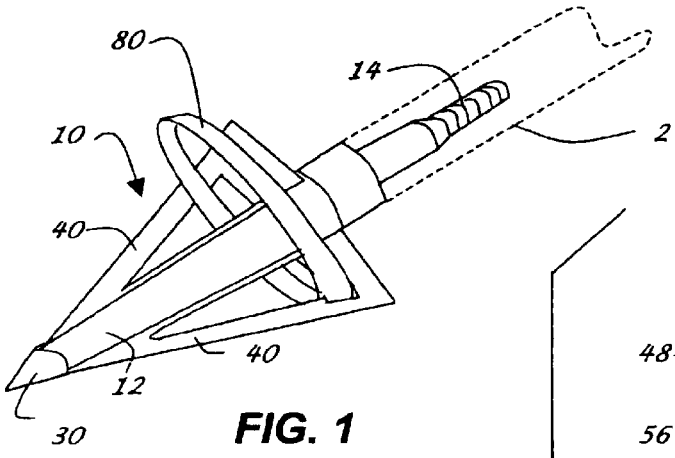
FIG. 1
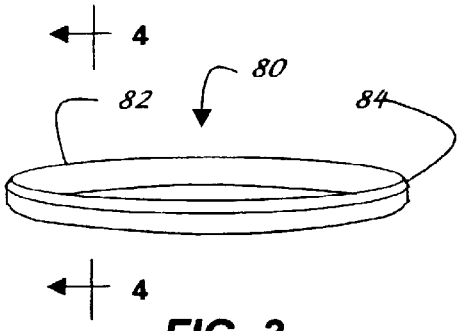
FIG. 3
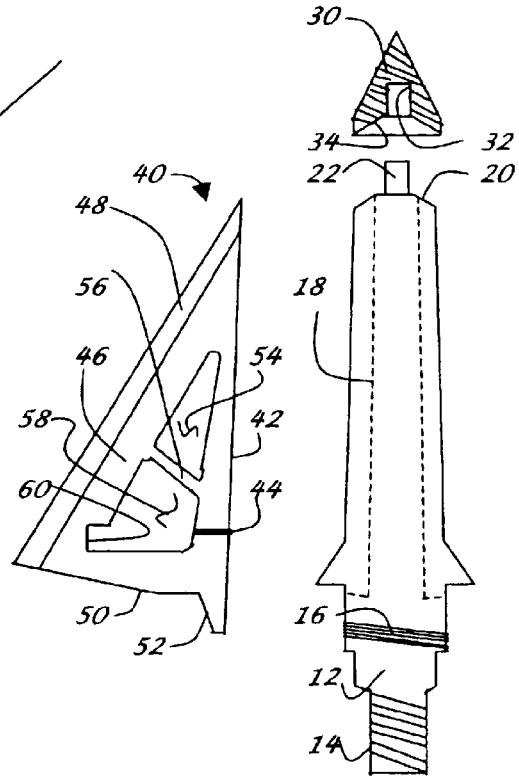
FIG. 2
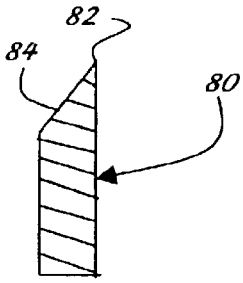
FIG. 4
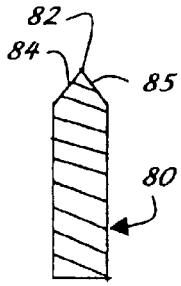
FIG. 4A
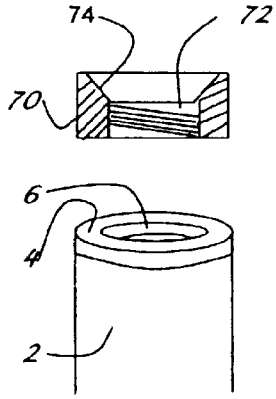

HUNTING ARROWHEAD WITH BLEEDER RING

BACKGROUND OF THE INVENTION

1. Field of the Invention

This invention relates to hunting arrowheads, and, more particularly, to broadhead type hunting arrowheads having a bleeder ring to promote bleeding of hunted game.

2. Description of the Prior Art

U.S. Pat. No. 2,888,264 (Sharrar et al) discloses a hunting arrow having a ring secured to the outer edges of blades at the arrowhead. The outer edges of the blades are notched to receive the ring. The ring is press fitted into the notches. With only a press fit, the ring may come loose from the arrow as the arrow is withdrawn from the game. Several embodiments are disclosed.

U.S. Pat. No. Re. 34,397 (DelMonte et al) discloses a hunting arrow having a ring secured to the inside of the blades of an arrow. The blades are triangular shaped and solid. The blades are notched from their inside edges, adjacent to the "tip shaft," to receive a ring. The ring is accordingly slightly larger in diameter than the "tip shaft."

SUMMARY OF THE INVENTION

The invention described and claimed herein comprises a hunting arrow with an arrowhead having a ring secured to blades secured to the arrowhead. The ring may be secured to the outer portion of the blades or to the inner portion of the blades. The blades are disposed in slots in a ferrule of the arrowhead and a lock nut secures them to the arrowhead and the arrowhead in turn is secured to the arrow shaft. The blades include open areas defined within a straight side which extends into slots in the ferrule, a sloping sharp side, and a lower side which extends from the sloping sharp side to the straight side. A single piece or monolithic arrowhead may be produced using various manufacturing methods, and this single piece arrowhead may then be secured to an arrow shaft. In such an arrowhead, the ring is an integral part of the arrowhead. In all embodiments disclosed, the ring is locked to the blades. Different configurations of cutting rings are disclosed.

Among the objects of the present invention are the following:

To provide a new and useful hunting arrow;

To provide a new and useful hunting arrow having a tip to which blades are secured;

To provide a new and useful tip for a hunting arrow having a ring secured to blades;

To provide a new and useful tip for a hunting arrow having a nut for securing blades to the tip;

To provide new and useful blades for a hunting arrow having a ring secured to the outer portion of the blades;

To provide new and useful blades for a hunting arrow having a ring secured to an inner portion of the blades;

To provide a new and useful arrowhead having a ring as an integral part of the arrowhead;

To provide a new and useful hunting arrowhead having a cutting ring secured at the front of blades;

To provide a new and useful hunting arrowhead having a cutting ring secured at the rear of blades;

To provide new and useful blades for a hunting arrow having a slit in the inner portion of the blades for receiving a cutting ring;

To provide a new and useful arrowhead for a hunting arrow having a symmetrical cutting ring;

To provide a new and useful arrowhead for a hunting arrow having an asymmetrical cutting ring; and To provide a new and useful hunting arrow having a plurality of blades secured to the tip of the arrow and a plurality of configurations of rings securable to the blades.

BRIEF DESCRIPTION OF THE DRAWING

FIG. 1 is a perspective view of the present invention.

FIG. 2 is an exploded view of the apparatus of the present invention.

FIG. 3 is a perspective view of a ring usable with the present invention.

FIG. 4 is a view in partial section taken generally along line 4—4 of FIG. 3.

FIG. 4A is a view in partial section taken generally along line 4—4 of FIG. 3 illustrating an alternate embodiment of the element of FIG. 4.

DESCRIPTION OF THE PREFERRED EMBODIMENT

Figure 5:
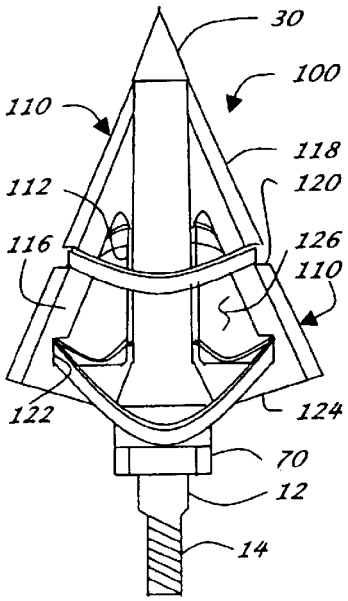
FIG. 5 is a side view of the apparatus of the present invention showing two different rings.

FIG. 1 is a perspective view of a hunting arrowhead or broadhead 10 of the present invention. FIG. 2 is an exploded view of the arrowhead 10 of FIG. 1. For the following discussion, reference will be made to FIGS. 1 and 2. The arrowhead 10 is shown in FIG. 1 with a a pair of blades 40 and a cutting ring 80 secured to the blades 40. The arrowhead 10 is secured to an arrow shaft 2 and is appropriately aligned with the longitudinal axis of the shaft 2, as is well known and understood for arrowheads.

In FIG. 2, only a single blade 40 is illustrated. The shaft 2 includes a front end face 4, and a threaded bore 6 extends into the shaft 2 at the front end face 4. The arrowhead 10 includes a ferrule or shank 12, and the ferrule or shank 12 includes a lower threaded portion 14 which extends into the threaded bore 6 of the shaft 2 to secure the arrowhead 10 to the shaft 2.

The ferrule 12 also includes a blade locking threaded portion 16 located a slight distance forwardly or upwardly from the lower threaded portion 14. A retainer nut 70, which will be discussed below, has internal threads which engage the threaded portion 16.

A plurality of slots extend into the ferrule 12 for receiving the blades 40. Two slots 18 are illustrated in FIG. 2. The slots 18 are shown in dotted line.

The ferrule 12 has a front end 20, and a pin 22 extends forwardly from the front end 20. A tip 30, shown in partial section, includes a bore 32 which receives the pin 22. It will be understood that the tip 30 could include a pin, and the shank 12 could include a bore for receiving the pin, if desired. The pin and bore may be press fitted or threaded, as desired.

The bore 32 extends upwardly from a tapered recess 34. When the blades 40 are disposed in their respective slots 18, the upper portions of the blades extend into the recess 34 to provide an upper lock for securing the blades to the ferrule 12.

The blade 40 has a generally triangular configuration, with a flat side 42 extending into a slot 18. The blade 40 also has a sloping side 46. A cutting edge 48 is defined at the outer portion of the sloping side 46. The sloping side 46 extends rearwardly to a bottom or base side 50. The bottom or base side 50 includes a slant portion 52.

There are two open areas shown for the blade 40, an upper open area 54 and a lower open area 58. The open areas 54 and 58 are shown divided by a strut 56. Extending "outwardly" into the side 46 from the lower open area 58 is a recess or notch 60.

Generally aligned with the recess 60 is a slit 44. The slit 44 extends through the flat side 42. The purpose of the slit 44 is to allow a ring 80 to be inserted into the open area 58. The ring 80 is then placed in the recess 60, as shown in FIG. 1. The slit 44 is shown in FIG. 2 exaggerated for illustrative purposes. The slit 44 is preferably sheared to minimize its width. The slit 44 is essentially closed when the retainer nut 70 is secured to the ferrule 12 and when the tip 30 is secured to the ferrule 12. The combined forces against the blades exerted by the tip 30 and by the retainer nut 70 essentially close the slit 44.

The notch 60 includes three sides, including a top or forward side, bottom side, and an inner side, with the top and bottom sides generally perpendicular to the longitudinal axis of the arrow shaft 2. The inner side of the notch 60 is generally parallel to the longitudinal axis of the shaft 2. The orientation of the sides of the notch 60 provide the appropriate orientation for the ring 80 with respect to the shaft 2 and the blade(s) 40.

The configuration of the notch 60 insures that the ring 80 is locked to the blades and will remain with the arrowhead when the arrow is withdrawn from the game.

The retainer nut 70 includes an inner threaded portion 72 which matingly or threadedly engages the threaded portion 16 of the ferrule or shank 12. The nut 70 also includes a sloping portion 74 which extends upwardly and outwardly from the threaded portion 72. The angle of the sloping or tapered portion 74 matches the slope of the tapered or slant portion 52 of the blade 40. Accordingly, when the blade 40 is inserted into a slot 18, the nut 70 is secured to the ferrule 12, and the sloping or tapered portion 74 is disposed against the tapered or slant portion 52 of the blade 40 to secure the blade 40 to the ferrule 12. In actuality, all of the blades 40 will be disposed in their respective slots 18 before the nut 70 is secured to the ferrule 12.

At the top of the arrowhead 10, the tip 30 is also secured to the ferrule or shank 12 to retain the upper portion of the blades 40 to the ferrule or shank 12, as discussed above. The taper of the recess 34 matches the angular relationship between the inner side 42 and the sloping outer side 46 to help securely hold the blades to the ferrule 12.

In FIG. 3, a ring 80 is shown in a slightly perspective view. FIGS. 4 and 4A show in partial section two embodiments of the ring 80. In FIG. 4, the ring 80 is shown to include a cutting edge 82 with a single beveled portion 84. In FIG. 4A, a pair of beveled portions 84 and 86 extending rearwardly and outwardly from the cutting edge 82. It will be understood that whether a single beveled edge or a double beveled edge is used for a ring is essentially immaterial for purposes of the present invention.

For inserting the cutting ring 80, the blades, typically 3 or 4, are stacked or aligned on top of each other, with the slits 44 also aligned. The ring 80 is then turned sideways and moved through the aligned slots 44 and into the lower open area 58. The ring 80 is then rotated ninety degrees to the orientation shown in FIG. 1 and the ring 80 is disposed in the recesses 60 of each blade. With the blades 40 disposed apart, the blades are then ready to be secured to the ferrule or shank 12.

The blades 40 are appropriately spaced apart and the inner sides 42 are then inserted into their respective slots 18 in the ferrule or shank 12. The tip 30 is secured to the ferrule 12 and the retainer nut 70 is also secured to the ferrule to secure the blades in place. The arrowhead 10 is then secured to the shaft 2.

FIG. 5 is a side view of another broadhead type hunting arrowhead 100 which is an alternate embodiment of the arrowhead apparatus 10 of FIGS. 1 and 2. The arrowhead 100 utilizes the same ferrule or shank 12, with the lower threaded portion 12 which extends into the threaded bore 6 of the shaft 2, as shown in FIGS. 1 and 2. The retainer nut 70 with the tip 30, are used to hold a plurality of blades 110 to the ferrule or shank 12.

Figure 5A:
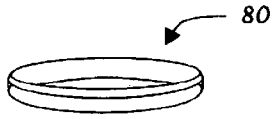
FIG. 5A is a view of a ring of the present invention.
Figure 5B:
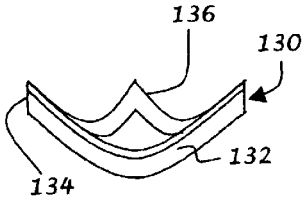
FIG. 5B is a view of an alternate embodiment of a ring of the present invention.

The blades 110 differ from the blades 40 in the ring retainer design, and in the ring design itself. Two different ring designs or configurations are illustrated in FIGS. 5, 5A and 5B. FIG. 5A is a slight perspective view of the ring 80, and FIG. 5B is a side view of an asymmetrical ring 130. For the following discussion, reference will be made to FIG. 5 and to FIGS. 5A and 5B, as appropriate.

The blades 110 includes an inner, straight side 112 with a slit, not shown, but may be understood from FIG. 2, a slant side 116 which includes a sharp edge 118. Extending inwardly from the sharp edge 118 is an outer or exterior recess 120.

The recess 120 includes a front or top or upper side, a bottom side, and an inner side. The upper or top side and the bottom side are generally parallel to each other and generally perpendicular to the inner side. The inner side is generally parallel to the longitudinal axis of the ferrule 12 and accordingly to the longitudinal axis of the arrow shaft 2. (See FIGS. 1 and 2.)

The blades 110 also include and a bottom side 124 with a slant or tapered portion which extends into the retainer nut 70, as discussed above. The bottom side extends from the slant side to the straight side to define with the straight side and the slant side a generally triangular configuration. The three sides also define within in them an open area 126.

At the juncture of the slant side and the bottom side of the blade 110 in the open area 126 is an interior recess 122. The recess 122 is essentially a mirror image of the recess 120. The recess 122 includes three sides, a top side, a bottom side, and an inner side. A cutting ring extends into the recess 122 and is disposed against the inner side and the top side to lock the cutting ring to the arrowhead 100.

The slit on the straight side of the blade 110 allows a cutting ring to be inserted into the open area 126, as discussed above and below. The slant or tapered portion of the bottom side 124 extends into the retainer nut 70, and the tip 30 receives the top portion of the blades to help secure the blades to the ferrule 12. The ferrule or shank 12 includes slots 18 to receive the inner, straight, sides 112 of the blades, as also may be understood from FIG. 2.

The recess 120 extends inwardly from the sharp, cutting edge 118 and into the outer portion or side 116, as discussed above, for receiving an outer cutting ring, such as the symmetrical cutting ring 80, illustrated in FIG. 5A.

The outer side or portion 116 also includes the inner recess 122 for receiving a cutting ring, as also discussed above. The cutting ring may either be a symmetrical cutting ring, such as the ring 80. An asymmetrical cutting ring 130 may also be disposed in the outer recess 120 or in the inner recess 122, as desired. In other words, both types of cutting rings may be disposed in either the outer, exterior, or the inner, interior, recesses, as desired. While two types of recesses, outer and inner, are illustrated in FIG. 5, typically a blade will have either one recess or the other, and may have both.

The cutting ring 80 as illustrated in FIG. 5A is repeated from FIG. 3 for comparative convenience with respect to the asymmetrical cutting ring 130 of FIG. 5B.

For receiving an inner cutting ring, such as the asymmetrical cutting ring 130, the inner or straight sides 112 of the blades 110 include slits, as discussed above, and as may also be understood from FIG. 2. The ring 130 may be inserted into the open area 124 in substantially the same way the ring 80 was inserted into the blades 40 as discussed above. The asymmetry of the ring 130 is immaterial with respect to insertion the blades of an arrowhead. The ring 130 is illustrated as having three lobes or scallops 132, 134, and 136. The lobes 132, 134, and 136 may be located equidistance apart, allowing aligned portions of the rings to be disposed in the aligned inner recesses 122.

The locations of the lobes or scallops may, of course, be correlated with the separation of the blades on a particular shank or ferrule, and also in accordance with the number of blades desired for an arrow. Obviously, an inner recess may be located as desired in a particular set of blades for a particular arrowhead to accommodate the location of blades and the design of a cutting ring. Similarly, notches in the blades may be disposed in an offset relationship for receiving an asymmetrical cutting ring.

Figure 6:
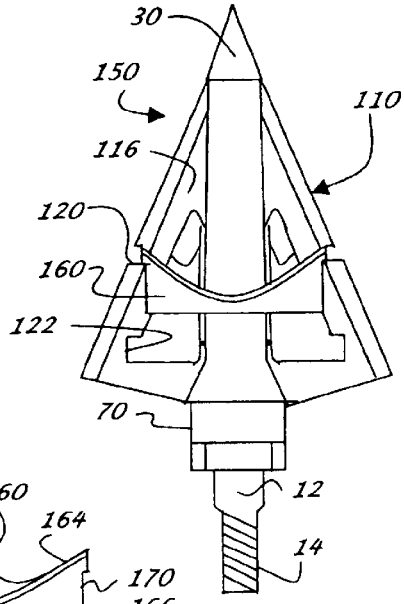
FIG. 6 is a side view of an alternate embodiment of the apparatus of the present invention.
Figure 6A:
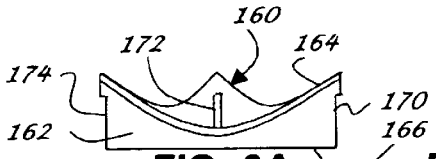
FIG. 6A is a view of the ring illustrated in FIG. 6.

Another type of asymmetric cutting ring is illustrated in FIGS. 6 and 6A. FIG. 6 is a side view of another alternate embodiment arrowhead 150. FIG. 6A is a side view of a cutting ring 160 for a blade 110 of the arrowhead 150. For the following discussion, reference will primarily be made to FIGS. 6 and 6A. The ferrule 12, the tip 30, and the retainer nut 70 function substantially as they do for the blades 110 of the arrowhead 100, and as they do for the blades 40 of the arrowhead 10. The difference with the arrowhead 150 is the design of the cutting ring 160. Also, the inner recesses 122 of the blade 110 are vacant. The cutting ring 160 is disposed in the outer recesses 120 of the blade 110.

The cutting ring 160 includes a base 162 with a scalloped top cutting portion 164. The base 162 includes a generally "flat" bottom 166. Three slots 170, 172, and 174 are appropriately spaced apart in accordance with the spacing of blades 110 about the ferrule or shank 12. The slots 170, 172, and 174 extend upwardly from the bottom 166 and terminate slightly below the cutting edge 164. The slots 170, 172, and 174 are aligned with three lobes, providing an asymmetrical cutting edge 164, but providing a generally flat bottom profile for the cutting ring. The slots 170, 172, and 174 extend into the recesses 120 and downwardly along the outer sloping sides 116 of the blades 110. That is, the slots 170, 172, and 174 receive a portion of the outer side 116. The distance between the top of the slots and the top edge 164 is appropriately dimensioned to extend into the recess 120.

Note that the generally rectangular configuration of the outer recesses 120 of the blade 110 and the orientation of the blades with respect to the recesses assures that the rings, either a symmetrical ring 80, or an asymmetrical ring, such as the ring 130 or the ring 160, will not remain embedded in the game as the arrow shaft 2 and an arrowhead is pulled outwardly to remove the arrow from the game. Regardless of what type of cutting ring is used with a particular blade design or arrowhead design, the configuration of the recesses which receive them insures that the cutting rings will be locked to their blades.

Figure 7:
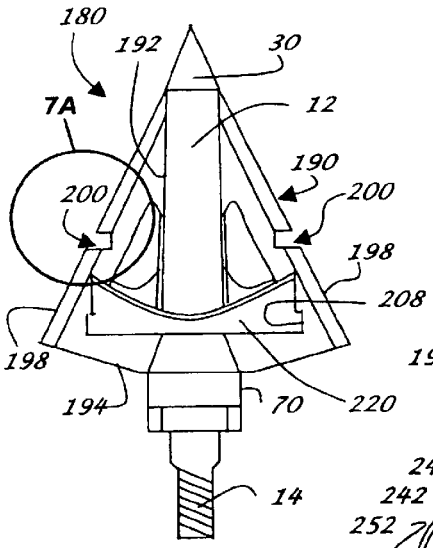
FIG. 7 is a side view of another alternate embodiment of the apparatus of the present invention.
Figure 7A:
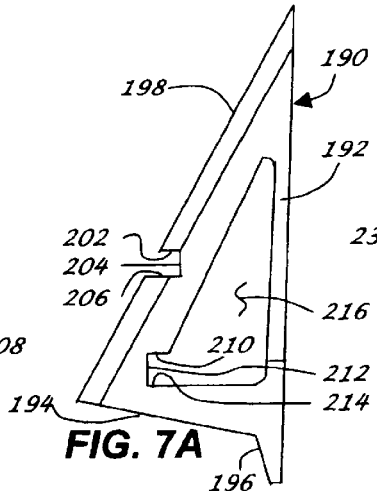
FIG. 7A is a view of a blade illustrated in FIG. 7.
Figure 7B:
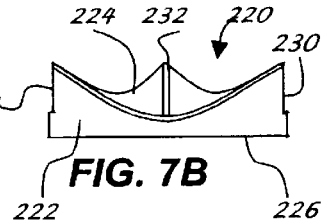
FIG. 7B is a view of the ring illustrated in FIG. 7.

FIG. 7 is a side view of another alternate embodiment 180 of the arrowhead apparatus of the present invention. FIG. 7A is a plan view of a blade 190. FIG. 7B is a side view of a cutting ring 220. For the following discussion, reference will primarily be made to FIGS. 7, 7A, and 7B.

The arrowhead apparatus 180 differs from the arrowhead apparatus 150 primarily in the design of a cutting ring 220. The arrowhead apparatus 180 includes the basic ferrule 12, with its various elements as discussed above functioning in substantially the same manner as discussed above with the arrowhead apparatus 10, 100, and 150. The arrowhead apparatus 180 includes a plurality of blades 190. The blades 190 are substantially the same as the blades 110. However, the cutting ring 220 is an inside cutting ring, extending into an inner recess 208 in each of the blades 190, while the cutting ring 160 of FIG. 6 and FIG. 6A is an outside cutting ring, disposed in the outer recesses 120.

The blades 190 include an inner straight side portion 192 which extends into a recess 18 in the ferrule 12, a lower side 194 which includes a tapered or sloping portion 196 which cooperates with the retainer nut 70 substantially as discussed above. The blades 190 also include an sloping outer cutting side 198. The upper juncture of the cutting side 198 and the inner side 192 extend into the recess in the bottom of the tip 30, substantially as discussed above.

The blades 190 also include an outer recess 200 and an inner recess 208. The ring 220 is shown disposed in the inner recesses 208 of the blades 190 in FIG. 7. The outer recess 200 is vacant.

Details of the outer or exterior recess 200 and of the inner or interior recess 208 are shown in FIG. 7A. The outer recess 200 includes a top side 202, an inner side 204, and a bottom side 206. The sides 202 and 206 are generally parallel to each other and generally perpendicular to the longitudinal axis of the shaft 2 and, of course, to the longitudinal axis of the ferrule 12. The inner side 204 is generally parallel to the longitudinal axes of the shaft 2 and the ferrule 12 and generally perpendicular to the sides 202 and 206. See FIG. 2. Thus, with an appropriate ring, either a ring 80 or a ring 130 or a ring 160, disposed in the recess 200, the top side 202 bears against the ring as the arrow is pulled from the game and insures that the ring moves with the arrow and does not stay in the game as the arrow is withdrawn. The configuration of the recess 200 is substantially the same as that of the other outer ring receiving recesses discussed above.

The inner recess 208 includes a top side 210, an outer side 212, and a bottom side 214. The top and bottom sides 210 and 214 are generally parallel to each other and are generally perpendicular to the longitudinal axes of the arrow shaft 2 and the ferrule 12. The outer side 212 is generally parallel to the longitudinal axes and generally perpendicular to the sides 210 and 214.

An open area 216 is disposed between the sides 192, 198, and 194, substantially the same as with the blades 110 of FIGS. 5 and 6. The blades 110 and 190 are substantially identical. However, it will be repeated that both outer recesses and inner recesses are illustrated for the blades 110 and 190. While blades may include both inner and outer recesses, and inner and outer cutting blades, typically a blade will have either an outer recess or an inner recess for receiving a single cutting ring. For convenience, both outer and inner ring receiving recesses are illustrated.

The cutting ring 220 has the same general configuration as the cutting ring 160. The cutting ring 220 includes a base 222, a scalloped top cutting edge 224, and a flat bottom. However, the ring 220 includes three slots 230, 232, and 234 which extend downwardly from the top cutting edge 224, which is just the opposite from the slots of the ring 160. The ring 220 is an inner cutting ring which extends into the recesses 208, with the slots receiving a portion of the outer sides 198 to lock the ring to the blades. The portion of a ring 220 below a slot extends into a recess 208 and is appropriately dimensioned for disposition against the side 212.

Figure 8:
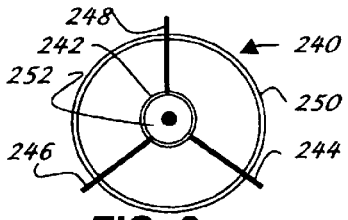
FIG. 8 is a front view of an arrowhead of the present invention.
Figure 9:
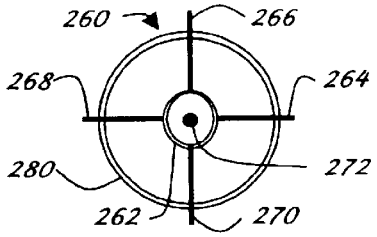
FIG. 9 is a front view of an alternate embodiment arrowhead of the present invention.

FIGS. 8 and 9 are front views of arrowheads 240 and 260, respectively, illustrating cutting rings of the present invention with a three bladed arrowhead and a four bladed arrowhead.

In FIG. 8, the arrowhead 240 includes a ferrule 242 and three blades 244, 246, and 248 are secured to the ferrule 242. A cutting ring 250 is secured to the blades 244, 246, and 248. Helping to secure the blades 244, 246, and 248 to the ferrule 242 at the front of the arrowhead 240 is a tip 252. The tip 252 accomplishes its securing function substantially as discussed above.

In FIG. 9, a four bladed arrowhead 260 is illustrated. The arrowhead 260 includes a ferule 262 to which four blades 264, 266, 268, and 270 are secured. A cutting ring 280 is in turn secured to the four blades 264 . . . 270. A tip 272 helps to secure the blades 264 . . . 270 to the ferrule 262, substantially as discussed above.

Figure 10:
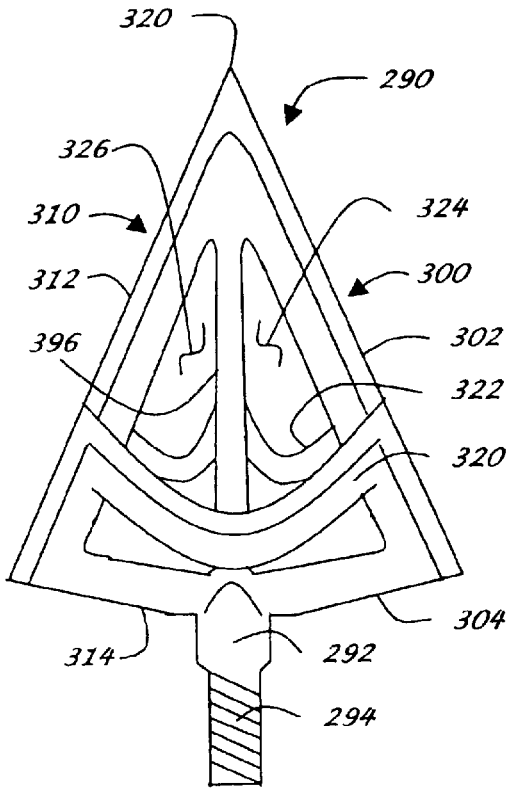
FIG. 10 is a side view of another alternate embodiment arrowhead of the present invention.

FIG. 10 is a side view of an integral or monolithic arrowhead 290. The arrowhead 290 includes a ferrule 292 with a lower threaded portion 294 which mates with an internally threaded bore at the front of an arrow shaft, as best shown in FIG. 2. The ferrule 292 also includes a cylindrical central portion 296.

Integral with the ferrule 292 are several blades, of which blades 300 and 310 are shown. Typically, the arrowhead 290 may have three blades spaced apart equidistant from each other. For convenience, only two blades 300 and 310 are illustrated in FIG. 10.

The blade 300 includes an outwardly and downwardly sloping or slant portion, the outer edge of which includes a sharp cutting edge 302, and a generally inwardly extending lower portion 304. The blade 310 includes a similar outwardly and downwardly extending sloping or slant portion, the outer edge of which includes a sharp cutting edge 312, and an inwardly extending lower portion 314. The lower portions 304 and 314 extend from the ferrule 292 generally inwardly from the lower portions of the respective slant portions to the ferrule 292.

Open areas 324 and 326 extend between the central portion 296 of the ferrule 292 and the slant portions and the bottom portions of the blades 300 and 310, respectively.

A pointed, sharp tip 320 is defined at the juncture of the blades.

A cutting ring 320, illustrated as a scalloped or asymmetrical ring, is integral with the blades. The ring 320 may also be symmetrical, as the ring 80. The ring 320 includes a sharp cutting edge 322. The integral or monolithic nature of the arrowhead 290 insures that the cutting ring 320 remains locked to the blades.

The arrowhead 300 may be molded or cast to provide the integral or monolithic unit. However, the edges of the blades and the cutting ring must be appropriately sharpened to define their respective sharp, cutting edges. Note how the cutting edge 322 of the cutting ring 320 blends directly to the cutting edges of the blades 300 and 310, and of course of another or other blades, as appropriate.

Figure 11:
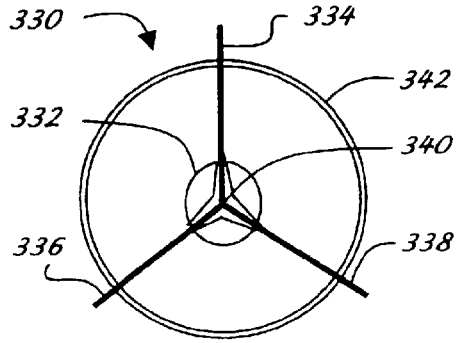
FIG. 11 is a front view of the arrowhead of FIG. 10.

FIG. 11 is a front view of a three bladed arrowhead 330. The arrowhead 330 includes a ferrule 332 and three blades 334, 336, and 338. A cutting ring 342 is secured to the three blades 334 . . . 338. The arrowhead 330 also includes a tip 340.

Figure 12:
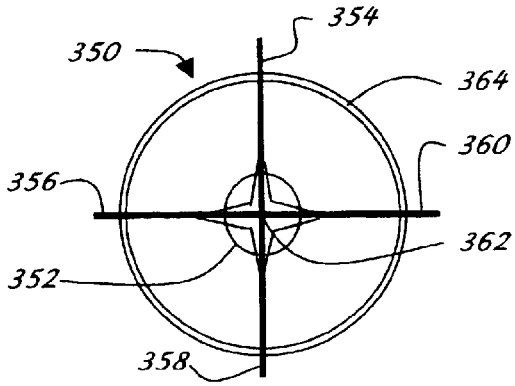
FIG. 12 is a front view of an alternate embodiment of the arrowhead of FIG. 10.

FIG. 12 is a front view of a four bladed arrowhead 350. The arrowhead 350 includes a ferrule 352 and four blades 354, 356, 358 and 360. The blades 354 . . . 360 are appropriately secured to the ferrule. A tip 362 is appropriately secured to the blades 354 . . . 360 and to the ferrule 352. A cutting ring 364 is also appropriately secured to the blades 354 . . . 360.

The cutting rings 342 and 364 are illustrated as being circular. They may be either symmetrical or asymmetrical, as desired.

Figure 13:
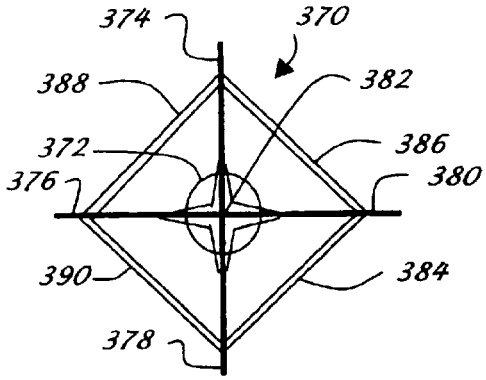
FIG. 13 is a front view of another alternate embodiment of the arrowhead of FIG. 10.

FIG. 13 is a front view of an arrowhead 370. The arrowhead 370 includes a ferrule 372 and four blades 374, 376, 378, and 380. The blades 374 . . . 380 are appropriately secured to the ferrule 372. A tip 382 is disposed at the front of the ferrule 372 and the four blades 374 . . . 380.

A generally square cutting ring is secured to the four blades 374 . . . 380. The cutting ring includes four portions, each of which extends between adjacent blades. The portions include a portion 384 between the blades 378 and 380, a portion 386 between the blades 380 and 374, a portion 388 between the blades 374 and 376, and a portion 390 between the blades 376 and 378.

Figure 14:
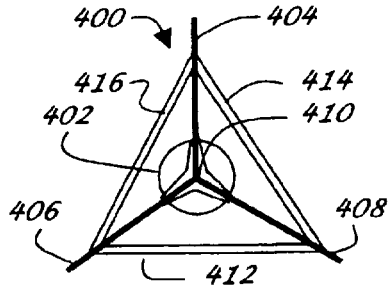
FIG. 14 is a front view of another alternate embodiment of the arrowhead of FIG. 10.

FIG. 14 is a front view of another arrowhead 400. The arrowhead 400 includes a ferrule 402 and three blades 404, 406, and 408 are secured to the ferrule 402. A tip 410 is disposed at the juncture of the three blades and the ferrule 402.

A generally triangularly shaped cutting ring having three portions extends between the blades. A ring portion 412 extends between the blades 406 and 408. A ring portion 414 extends between the blades 408 and 404. A ring portion 416 extends between the blades 404 and 406. The ring portions are illustrated as being generally straight, as are the cutting ring portions 384 . . . 390 of the arrowhead 370.

The arrowheads of FIGS. 11, 12, 13, and 14 may be made monolithic or integral, as by casting or molding methods, as with the arrowhead 290 of FIG. 10. The arrowheads may alternatively be made of separate parts, as with the arrowheads 10, 100, 150, and 180 of FIGS. 1 and 2, and FIGS. 5, 6, and 7, respectively. With the present casting or molding technologies, the sharp edges of the blades and the cutting rings typically may require sharpening after the casting or molding processes.

Figure 15:
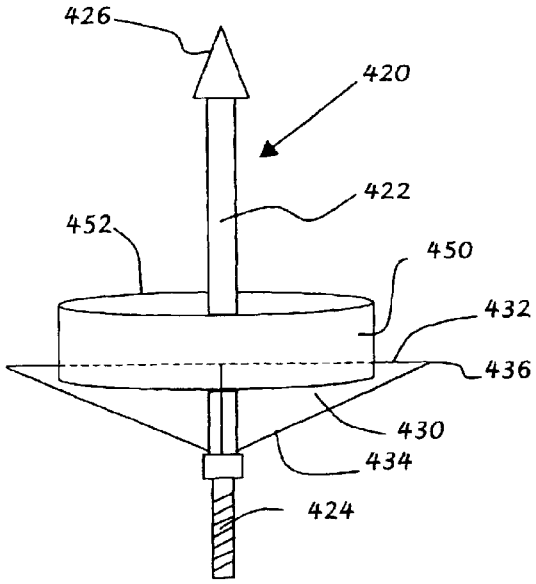
FIG. 15 is a very slightly tilted schematic front view of another alternate embodiment of the arrowhead of the present invention.
Figure 15A:
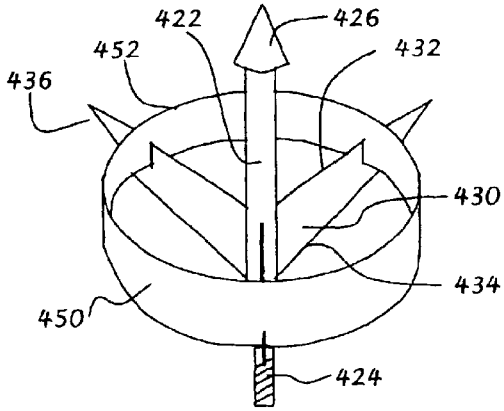
FIG. 15A is a slightly tilted perspective view of the arrowhead of FIG. 15.

FIG. 15 is a schematic front view, very slightly tilted, or very slightly perspective, of another alternate embodiment 420 of the present invention. FIG. 15A is a schematic front view, slightly tilted, or very slightly perspective, of the apparatus 420 of FIG. 15. FIG. 15A is tilted forwardly slightly more than FIG. 15. For the following discussion, reference will primarily be directed to FIGS. 15 and 15A.

The arrowhead apparatus 420 includes a ferrule 422, with a threaded lower portion 424 and a pointed tip 426. A plurality of blades 430 are appropriately secured to the ferrule 422. Three blades 430 are illustrated.

The blades 430 differ from those illustrated in the above discussed embodiments in that the each blade 430 includes a cutting edge 432 which is generally perpendicular to the longitudinal axis of the ferrule 422 and accordingly also to the longitudinal axis of an arrow shaft to which the ferrule 422 will be attached.

Each blade also includes a trailing edge 434 which tapers or slants rearwardly and inwardly from an outer tip 436 of each blade. Thus, the blades 430 are generally triangular in shape or configuration, as are the blades of the above discussed embodiments, but the orientation of the blades 430 on a ferrule is different from the blades of the above discussed embodiments. The blades 430 also have a different overall configuration or proportion from the blades of the above discussed embodiments.

A cutting ring 450 is appropriately secured to the blades 430. The ring 450 extends into slits in the blades adjacent to, but inwardly from, the outer tips 436 of each blade 430. The cutting ring 450 includes a sharp cutting edge 452 at the top or front of the ring. The ring 450 leads the blades in the arrowhead apparatus 420, with the cutting edges 432 of each blade slightly below the cutting edge 452 of the ring 450.

Figure 16:
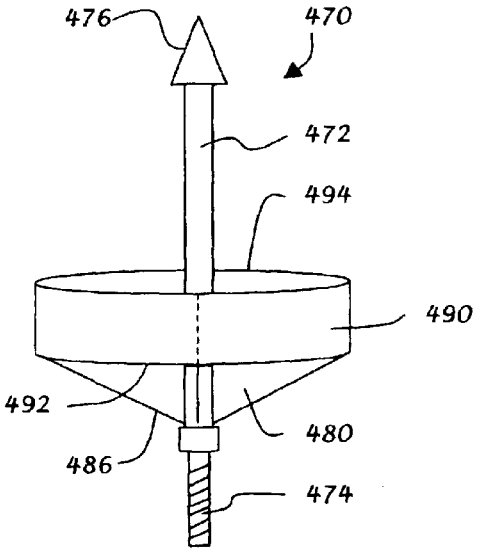
FIG. 16 is a very slightly tilted schematic front view of an alternate embodiment of the arrowhead of FIG. 15.
Figure 16A:
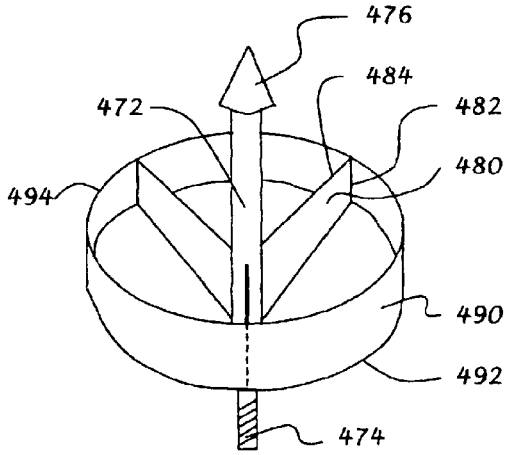
FIG. 16A is a slightly tilted schematic perspective view of the arrowhead of FIG. 16.

FIG. 16 is a schematic front view, very slightly tilted, or a very slight perspective view, of an alternate embodiment arrowhead 470 of the present invention, comprising specifically an alternate embodiment of the arrowhead apparatus 420 of FIGS. 15 and 15A. FIG. 16A is a slightly tilted perspective view of the arrowhead apparatus 470 of FIG. 16. FIG. 16A, like FIG. 15A, is tilted forwardly slightly more than FIG. 16. For the following discussion, reference will primarily be made to FIGS. 16 and 16A.

The arrowhead apparatus 470 includes a ferrule 472, and the ferrule 472 includes a lower threaded portion 474 and a pointed tip 476, similar to the arrowhead apparatus 420. The arrowhead apparatus 470 also includes three blades 480. The blades 480 are appropriately secured to the ferrule 472.

The blades 480 include outer ends 482, top sharp surfaces 484, and bottom surfaces 486. The blades 480 are generally triangular in configuration, like the blades 430 of FIGS. 15 and 15A. The top, sharp, surfaces 484 are generally perpendicular to the longitudinal axis of the ferrule 472, and accordingly of the arrow shaft to which the ferrule 472 is secured. The bottom edges 486 extend inwardly and downwardly from the outer edges 482 to the ferrule 472.

A cutting ring 490 is secured to the outer ends 482 of the blades 480. The cutting ring 490 includes a bottom surface 492 and a sharp top surface 484. The sharp top surface 494 is planarly aligned with the sharp top surfaces 484 of the blades 480.

The length of the outer ends 482 of the blades 480 is the same as the height of the ring 490. This is best shown in FIG. 16A.

Both the arrowheads 420 and 470 may best be made as integral or monolithic elements, as discussed above. Casting or molding processes of current technology may be best applied to making such monolithic or integral arrowheads. Again, the cutting rings are locked to their blades.

It will be noted that only the blades 40 of FIGS. 1 and 2 are illustrated as including a strut 56 for dividing the open area within the blades into two open areas 54 and 58. The other blades illustrated may also include such struts for providing strength for the blades. The blades of broadhead arrowheads may include open areas for reducing weight, and the struts provide structural reinforcement for the blades. For convenience in illustrating the elements of the present invention, struts are only shown in FIGS. 1 and 2.

Moreover, while the cutting edges are shown as generally smooth, it will be understood that they may alternatively be serrated, etc.

Blades of broadhead hunting arrows are typically razor thin and razor sharp. The thickness of the blades and rings illustrated in some of the drawing Figures have been exaggerated as required for illustrative purposes. In some drawing Figures, the blades are schematically illustrated merely as single lines without inherent thickness.

Either exterior notches, on the sharp side of blades, or interior notches, on the inside of a sloping portion of a blade, extending into the sloping portion from an open area of the blades, or communicating therewith, or both types of notches, may be used with cutting rings. Both interior and exterior notches lock the cutting rings to the blades.

While the principles of the invention have been made clear in illustrative embodiments, without departing from those principles there may occur to those skilled in the art modifications of structure, arrangement, proportions, the elements, materials, and components used in the practice of the invention, and otherwise, which are particularly adapted to specific environments and operative requirements. The appended claims are intended to cover and embrace any and all such modifications within the limits only of the true spirit and scope of the invention.

What we claim is:

1. A broadhead hunting arrow comprising in combination:

a shaft having a longitudinal axis;

a ferrule secured to the shaft;

a plurality of blades secured to the ferrule and each blade includes a straight side, a sloping side, and a lower side, and an open area within the three sides, and a sharp edge is on the sloping side;

a notch in the sloping side of each blade having a forward side generally perpendicular to the longitudinal axis of the shaft; and ring means disposed in the notches and against the forward side of each notch for cutting a bleeder hole in game pierced by the arrow, with the forward side of each notch insuring that the ring means stays with the blades as the arow is withdrawn from the game.

2. The apparatus of claim 1 in which the plurality of blades comprises three blades spaced apart on the shaft.

3. The apparatus of claim 1 in which the ring means comprises a symmetrical ring.

4. The apparatus of claim 1 in which the ring means comprises an asymmetrical ring.

5. The apparatus of claim 4 in which the notches in the blades are in an offset relationship for receiving the asymmetrical ring.

6. The apparatus of claim 1 in which the notch in each blade is on the sharp edge of each blade.

7. The apparatus of claim 1 in which the notch is on the sloping side communicating with the open area.

8. The apparatus of claim 7 in which the straight side includes a slit through which the ring means extends into the open area and then into the notch.

9. The apparatus of claim 1 which further includes a strut extending across the open area of each blade to provide strength for the blade.

10. A broadhead hunting arrow comprising in combination:

a shaft having a longitudinal axis;

an arrowhead threadedly secured to the shaft, including a plurality of slots for receiving a plurality of blades;

a plurality of blades in the plurality of slots of the arrowhead, and each blade includes a sharp edge and a tapering rear edge;

ring means secured to the plurality of blades for cutting a bleeder hole in game pierced by the arrow, including a ring disposed on the sham edges of the blades; and a retainer nut threadedly engaging the arrowhead and having a tapering portion disposed against the tapering rear edge of the blades for locking the blades to the arrowhead.

11. The apparatus of claim 10 in which each blade of the plurality of blades includes a notch for receiving the ring means.

12. Te apparatus of claim 11 in which the ring means includes a ring having a double beveled sharp edge.

13. The apparatus of claim 11 in which the ring means includes a ring having a single beveled sharp edge.

14. The apparatus of claim 11 in which the ring means includes a symmetrical ring having a sharp edge.

15. The apparatus of claim 11 in which the ring means includes an asymmetrical ring having a sharp edge.

16. The apparatus of claim 15 in which the ring means includes a plurality of slots extending from the sharp edge for receiving a portion of the blades adjacent to the notches.

17. The apparatus of claim 15 in which the ring means includes a generally flat bottom, and the plurality of slots extends upwardly from the flat bottom.

18. An arrowhead for a hunting arrow comprising in combination:

a ferrule having a longitudinal axis;

a plurality of blades secured to the ferrule and each blade has a cutting edge generally perpendicular to the longitudinal axis of the ferrule;

a cutting ring secured to the plurality of blades; and the ferrule, the plurality of blades, and the cutting ring are monolithic for locking the cutting ring to the blades.

19. The arrowhead of claim 18 in which the blades of the plurality of blades have sharp edges, and the cutting ring has a sharp edge which blends with the sharp edges of the blades.

20. The arrowhead of claim 19 in which the cutting ring has a sharp edge, and the sharp edge is planarly aligned with the sharp edges of the blades.

21. Arrowhead apparatus for a hunting arow comprising in combination:

a ferrule;

a plurality of slots in the ferrule for receiving blades;

a plurality of blades disposed in the plurality of slots, and each blade includes a straight side disposed in a slot, a sloping side extending downwardly and outwardly from the straight side and having a sharp cutting edge, a lower side extending from the sloping side to the straight side, the sloping side, the lower side, and the straight side defining a generally triangular configuration, and an open area defined within the straight side, the sloping side, and the lower side;

an exterior notch on each blade, including a forward portion, a side portion generally perpendicular to the forward portion, and a bottom portion generally parallel to the forward portion; and a cutting ring disposed and locked in the notches of each blade.

22. The apparatus of claim 21 which further includes a tip securing to the ferrule and receiving a portion of each blade for helping to secure the blades to the ferrule.

23. The apparatus of claim 22 which further includes a retainer nut for helping to secure the blades to the ferule.

24. The apparatus of claim 23 in which the lower side of each blade includes a tapered portion, and the retainer nut includes a tapered bore portion for receiving the tapered portion of the blades for helping to secure the blades to the ferrule.

25. Arrowhead apparatus comprising in combination:

a ferrule;

a plurality of slots in the ferrule for receiving blades;

a plurality of blades disposed in the plurality of slots, and each blade includes a straight side disposed in a slot, a sloping side extending downwardly and outwardly from the straight side and having a sharp cutting edge, a lower side extending from the sloping side to the straight side, the sloping side, the lower side, and the straight side defining a generally triangular configuration, and an open area within the three sides;

an interior notch on the sloping side of each blade and communicating with the open area, including a forward portion, a side portion generally perpendicular to the forward portion, a bottom portion generally parallel to the forward portion; and a cutting ring disposed and locked in the notches of each blade.

26. The apparatus of claim 25 in which the straight sides of the blades include a slit through which the cutting ring passes into the open area in order to be disposed in the interior notches.

* * * * *